US009702166B2

(12) United States Patent
Zhang

(10) Patent No.: US 9,702,166 B2
(45) Date of Patent: Jul. 11, 2017

(54) SECURE SOLENOID DRIVEN DEADBOLT LOCK

(71) Applicant: Digilock Asia Ltd., Kowloon (HK)

(72) Inventor: An Zhang, Shaoguan (CN)

(73) Assignee: Digilock Asia Ltd., Kowloon, Hong Kong (HK)

( * ) Notice: Subject to any disclaimer, the term of this patent is extended or adjusted under 35 U.S.C. 154(b) by 301 days.

(21) Appl. No.: 14/503,088

(22) Filed: Sep. 30, 2014

(65) Prior Publication Data

US 2015/0267442 A1 Sep. 24, 2015

(30) Foreign Application Priority Data

Mar. 19, 2014 (CN) ..... 2014 2 0126060 U

(51) Int. Cl.

| | |
|---|---|
| ***E05C 1/06*** | (2006.01) |
| ***E05B 47/00*** | (2006.01) |
| ***E05B 47/02*** | (2006.01) |
| ***E05B 15/00*** | (2006.01) |

(52) U.S. Cl.

CPC ..... *E05B 47/0004* (2013.01); *E05B 15/0086* (2013.01); *E05B 47/0002* (2013.01); *E05B 47/02* (2013.01); *E05B 47/026* (2013.01); *E05B 2047/0058* (2013.01); *Y10T 292/1015* (2015.04)

(58) Field of Classification Search

CPC .. E05B 15/0086; E05B 47/00; E05B 47/0001; E05B 47/0002; E05B 47/0003; E05B 47/0004; E05B 47/02; E05B 47/026; E05B 2047/0058; Y10T 292/0974; Y10T 292/0975; Y10T 292/1015; Y10T 292/1021; Y10T 292/11; Y10T 70/7028; Y10T 70/7051; Y10T 70/7062; Y10T 70/7102; Y10T 70/7113

See application file for complete search history.

(56) References Cited

U.S. PATENT DOCUMENTS

| | | | | | |
|---|---|---|---|---|---|
| 2,325,225 | A * | 7/1943 | Burke | E05B 47/0002 | 292/123 |
| 4,613,176 | A * | 9/1986 | Kelly | E05B 47/0002 | 292/201 |
| 5,511,832 | A * | 4/1996 | Kunzel | E05B 53/003 | 292/141 |
| 5,755,126 | A * | 5/1998 | Lanigan | E05B 47/0002 | 292/201 |
| 5,806,355 | A * | 9/1998 | Lanigan | E05B 47/0002 | 248/282.1 |
| 6,049,448 | A * | 4/2000 | Lanigan | E05B 47/0002 | 361/172 |

(Continued)

*Primary Examiner* — Alyson M Merlino
(74) *Attorney, Agent, or Firm* — Thomas M. Freiburger

(57) ABSTRACT

An electronic lock driven by a keep solenoid has a non-direct mechanical connection between the solenoid plunger and the slidable deadbolt of the lock. The connection includes a pivoted lever connected to the plunger and a link between the lever and the deadbolt, these components being arranged in such a way that when the deadbolt is fully extended the pivot point of the lever and pivot points on both ends of the link, with the lever and with the deadbolt, are in alignment. The mechanical arrangement prevents retraction of the extended deadbolt by pushing inward on the deadbolt, which is a problem with a deadbolt driven directly by a solenoid plunger.

3 Claims, 7 Drawing Sheets

(56) References Cited

U.S. PATENT DOCUMENTS

| | | | | | |
|---|---|---|---|---|---|
| 6,079,755 | A * | 6/2000 | Chang | E05B 47/0002 | 292/144 |
| 6,098,433 | A * | 8/2000 | Maniaci | E05B 47/0002 | 292/144 |
| 6,655,180 | B2 * | 12/2003 | Gokcebay | G07C 9/00674 | 340/5.2 |
| 2003/0011200 | A1 * | 1/2003 | Oxley | E05B 81/22 | 292/138 |

* cited by examiner

SECURE SOLENOID DRIVEN DEADBOLT LOCK

BACKGROUND OF THE INVENTION

The invention is concerned with electrically driven locks, and in particular is directed to solenoid driven deadbolt locks, a particular case being those driven by keep solenoids.

Electrically operated locks are often driven by a solenoid, with the reciprocable solenoid plunger driving a deadbolt or spring latch of the lock. In such a lock a spring can be positioned to push the deadbolt or spring latch to the extended position, while retraction is effected by powering the solenoid, to retract the plunger.

Electric locks have often employed a specific type of solenoid known as a keep solenoid, so that, especially in the case of a deadbolt lock, whether the lock bolt is extended or retracted, no power is required to maintain the position. A keep solenoid has both a permanent magnet and an electric coil. The spring loaded solenoid plunger is released outwardly when the coil is energized in a first polarity, creating an approximately equal but opposite magnetic force to that of the permanent magnet, effectively neutralizing the permanent magnet. This allows the spring to cause the outward movement of the plunger. When the solenoid coil is energized in the opposite, second polarity, it creates a magnetic force aligned with that of the permanent magnet, essentially doubling the magnet pulling power, overcoming the spring and pulling the plunger to the inward retracted position.

Thus, use of a keep solenoid in an electrically actuated lock is advantageous, due to the fact that the locking element can be moved from lock to unlock and from unlock to lock states with momentary use of power, with no additional power required to keep the lock in either the locked or unlocked state after the use of momentary power.

However, certain disadvantages arise from the use of a keep solenoid. First, the travel distance of the plunger is limited by the size of the magnet and coils, and the power source. Utilizing commercially available battery cells such as AA, AAA or 9 volt, only a small throw distance can be achieved for the lock element, approximately 7 mm or ¼ inch given practical considerations. Theoretically the throw could be longer from action of the spring, but if the throw is too long the solenoid and permanent magnet will not be able to retract the plunger and the lock element. This factor, along with battery and magnet requirements, must be balanced against desired throw distance in the lock design, and thus there is a practical limit on bolt throw distance.

A second important shortcoming of a keep solenoid-driven lock is that the locking element or bolt can be pushed back if someone can gain access to any part of the bolt and push it back using a finger or a tool. This is also a failing of simple solenoid driven locks, as opposed to keep solenoids, as outlined above. One need only overcome the relatively light force of a spring in order to push the locking element back and open the door or cabinet.

SUMMARY OF THE INVENTION

The electric lock of the invention overcomes both these problems, by use of an indirect drive mechanism between a solenoid plunger and a lock element, especially a bolt.

The lock unit has a housing, and within the housing is a reciprocating bolt and a solenoid, preferably, a keep solenoid. Interacting between the plunger of the keep solenoid and the bolt are two pivoted mechanical elements. A lever connected to the plunger is pivotally mounted at a pivot point on the housing. One arm of the lever is on the plunger side of the pivot point and is attached to the end of the plunger, while the second arm of the lever extends toward the lock element or bolt, but is not connected directly to the bolt. Between the second arm of the lever and the bolt is a link, pivotally connected both to the lever's second arm and to the base end of the bolt. The solenoid plunger is arranged relative to the first arm of the lever so that with the travel of the plunger, the first arm swings back and forth. The second arm of the lever is longer than the first, so that a greater travel distance is produced at the end of the second arm. The link is positioned such that when the lever swings one way, it causes, through the link, the bolt to be retracted. Rotation of the lever in the other direction (by the plunger), causes the lever, through the link, to fully extend the bolt. A greater throw distance for the bolt is produced by this mechanical arrangement, as compared to lock bolts directly driven by a solenoid plunger.

Moreover, and importantly, the link and pivoted lever are so arranged that the link is in alignment with the second arm of the lever when the bolt is fully extended. In other words, the pivot point (of the lever as pivoted on the housing) and the two pivoted connections of the link (to the second arm and to the bolt) form three points which are all in alignment. With this alignment, the bolt or lock element cannot be pushed back inwardly even if one could reach the bolt with a hand or a tool. The alignment of the link and the second arm of the lever will rigidly hold the extended bolt in place.

It is thus an object of the invention to improve the operation of an electrically operated lock, particularly a deadbolt lock, by providing a mechanical linkage between a solenoid plunger and locking element such that the components of the mechanical linkage provide a greater travel or throw of the locking element and such that the locking element cannot be forced back inwardly when it is in a fully extended state. These and other objects, advantages and features of the invention will be apparent from the following description of a preferred embodiment, considered along with the accompanying drawings.

DESCRIPTION OF PREFERRED EMBODIMENTS

Figure 5:
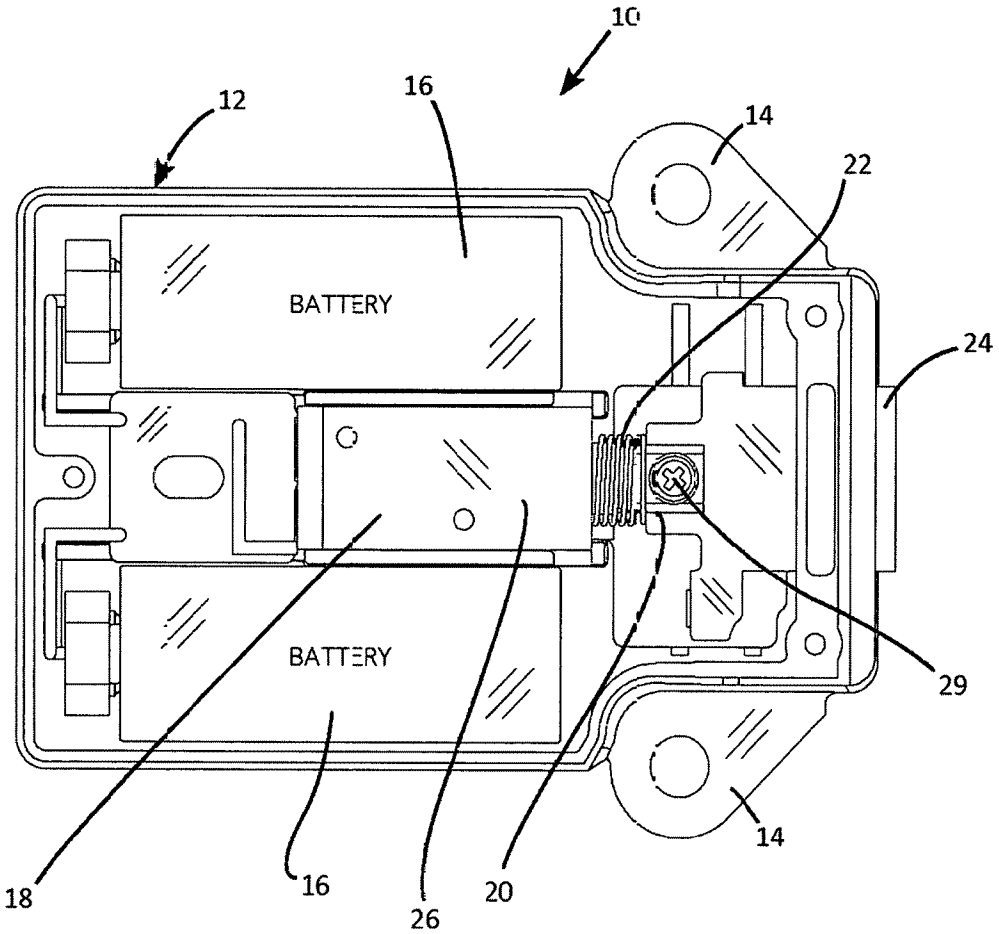
FIG 5 PRIOR ART
FIG. 5 is an elevation view showing a solenoid operated lock according to the prior art, shown with a housing cover removed and with a deadbolt in retracted position.
Figure 6:
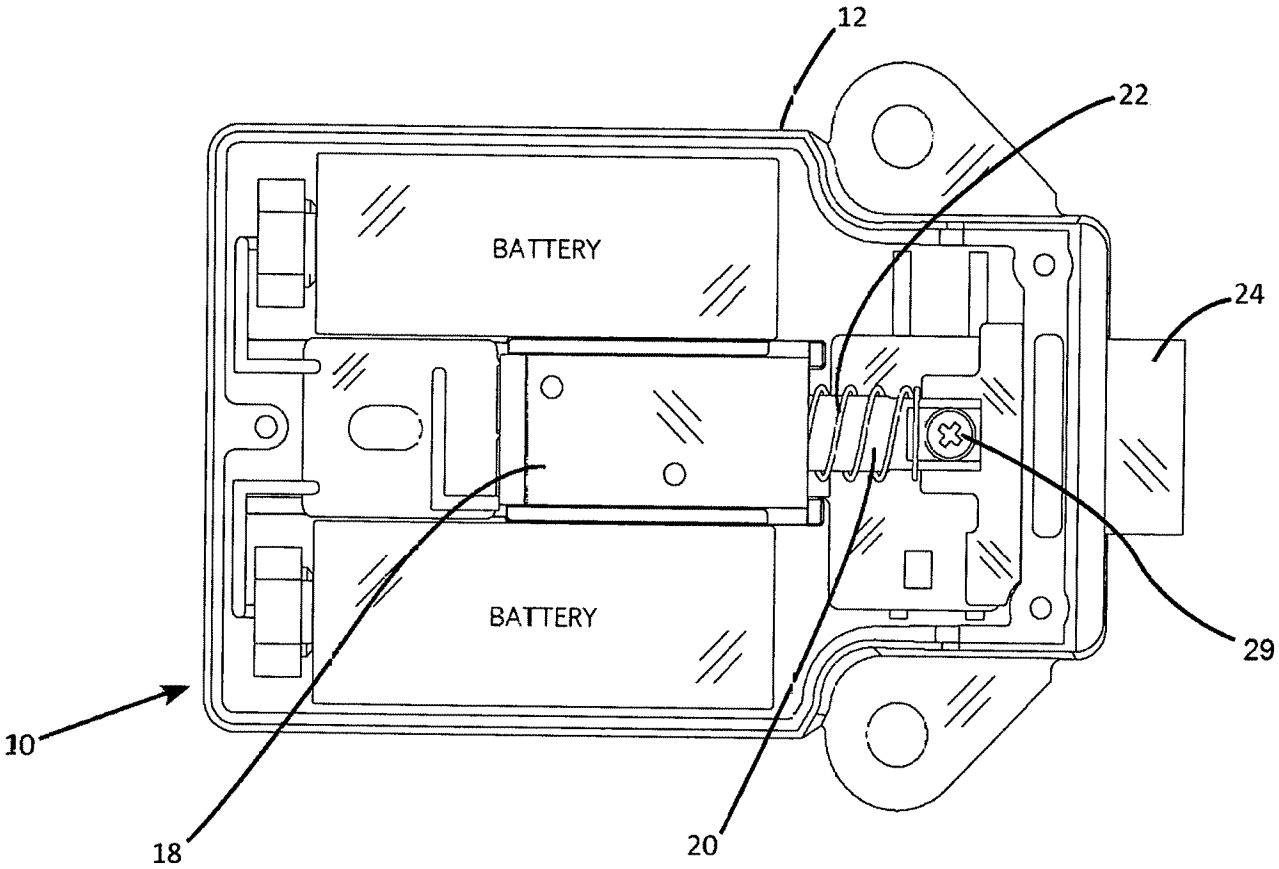
FIG 6 PRIOR ART
FIG. 6 is a view of a prior art lock unit as in FIG. 5, but with the deadbolt fully extended.
Figure 7:
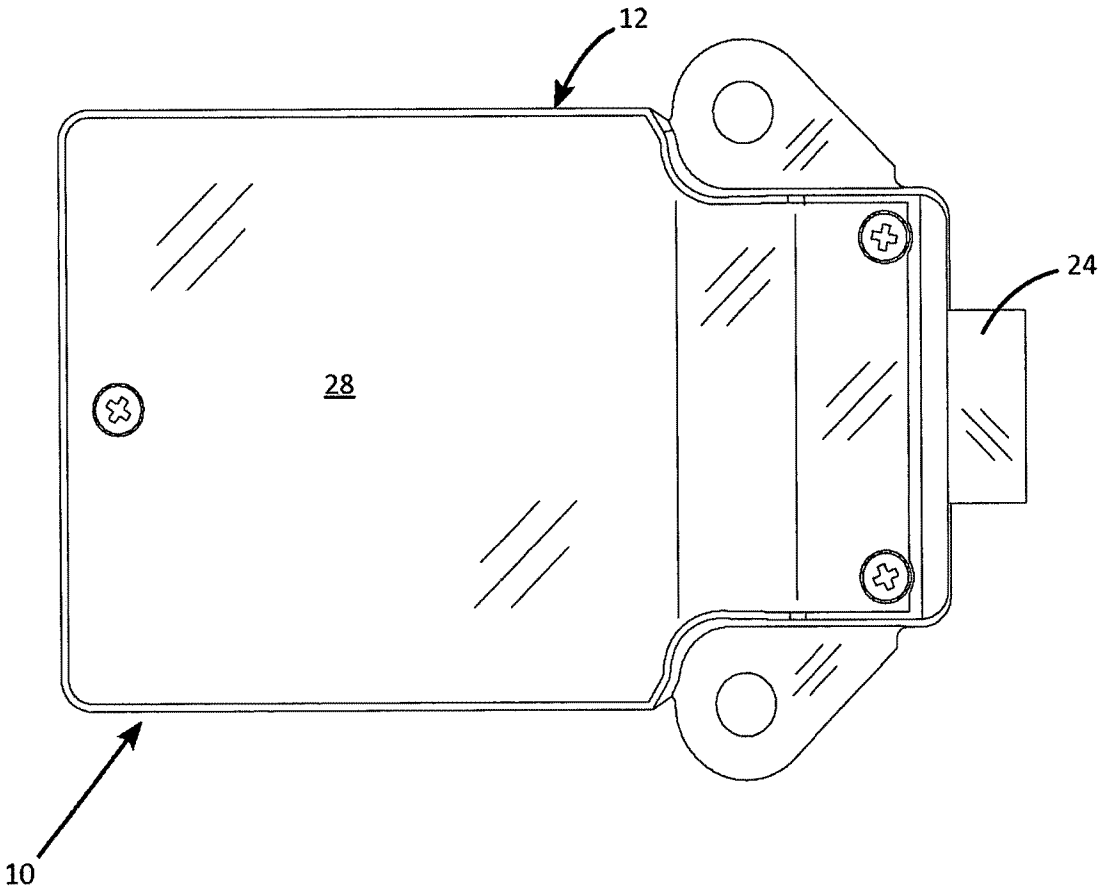
FIG 7 PRIOR ART
FIG. 7 is a view showing the prior art lock unit with a cover on the housing.

A typical prior art solenoid driven electric locks is shown in FIGS. 5, 6 and 7. The lock 10 has a housing 12 with securing flanges 14, the housing containing batteries 16 (two shown, e.g. 9 volt batteries) and a solenoid unit 18 having a plunger 20 driven outwardly or inwardly. The solenoid has a coil (not seen in the drawing) that creates a field when powered and exerts an electromagnetic force on the plunger 20. In this case the solenoid 18 of the lock device 10 is a keep solenoid as described above. The solenoid has a spring 22 which urges the plunger 20, and an attached reciprocating locking element or bolt 24, outwardly. However, the force of the spring is normally overcome by a permanent magnet which is contained within the end 26 of the solenoid casing or unit 18. As already described, when battery power at one polarity is put to the solenoid, this creates a magnetic field that will essentially neutralize that of the permanent magnet, allowing the spring 22 to push the bolt 24 out to its extended position as shown in FIG. 6. Only a momentary voltage need be applied to the solenoid coil, because once the plunger 20 (and the lock bolt 24) have reached the fully extended position, the permanent magnet can no longer pull the plunger back inward against the spring 22. FIG. 7 also shows the fully extended position of the lock bolt 24, with the housing 12 closed by a cover 28.

For retraction of the lock bolt 24, the solenoid coil is momentarily powered at an opposite polarity, and in this state it produces a magnetic field that adds to that of the permanent magnet and is sufficient to overcome the force of the spring 22, retracting the plunger 20 and lock bolt 24 to the retracted position shown in FIG. 5. Again, only momentary powering of the solenoid is required, since the permanent magnet will now keep the plunger and bolt in the retracted position. FIGS. 5 and 6 show that the keep solenoid 18 in this typical prior art construction directly drives the bolt 24, the plunger 20 being secured to the bolt with a fastener 29. As explained earlier, if one could get access to the lock bolt 24 as with a tool or other device to frictionally engage the bolt 24 to enable pushing it back, this would unlock the lock, allowing access to the door or other closure. Further, the direct drive with the keep solenoid produces a limited throw for the bolt, limited as a practical matter to about 7 mm or ¼ inch as explained above.

Figure 1:
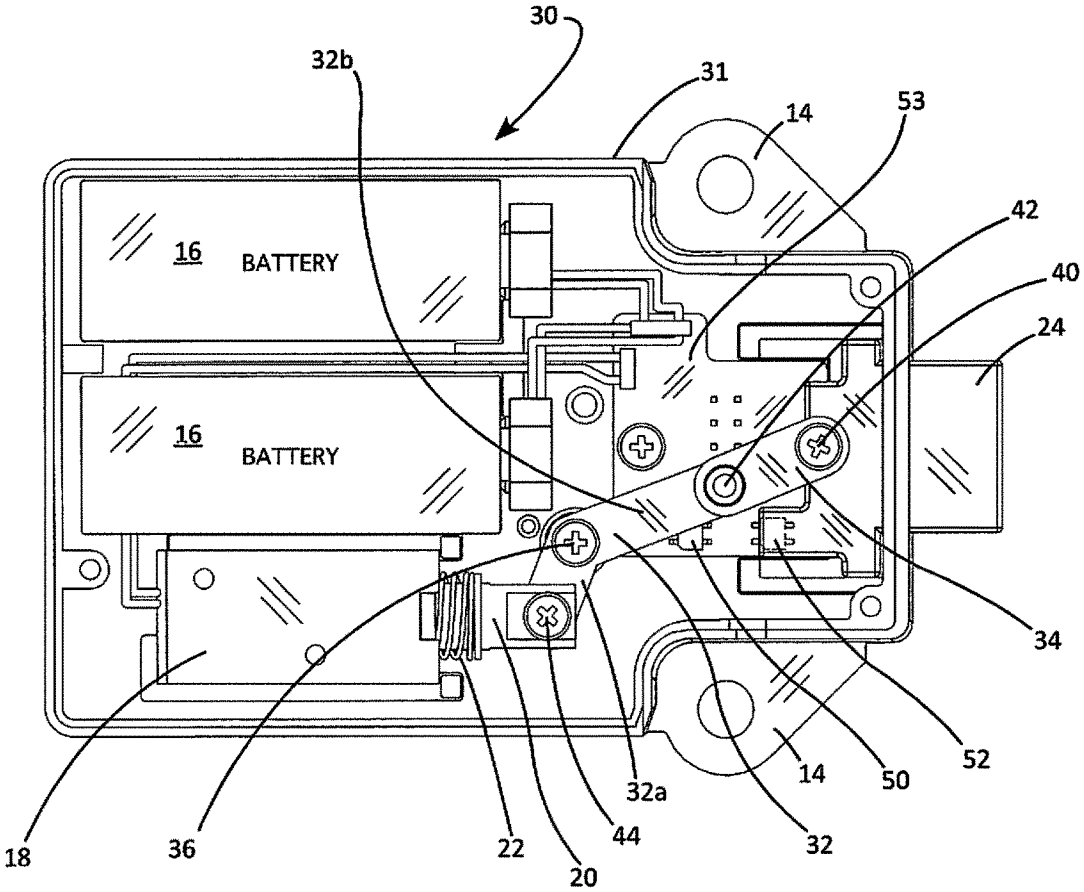
FIG. 1 is an elevation view of an electrically operated lock in accordance with the invention, with a housing cover removed, and showing a locking element in fully extended (locked) position.

FIGS. 1 through 4 show a form of the lock 30 of the invention, contained in a lock housing 31. A greater throw of the lock bolt 24 is permitted by the invention, and, as shown in FIG. 1, when the bolt 24 is fully extended it cannot be pushed back against spring force but is securely and rigidly held in position.

Figure 2:
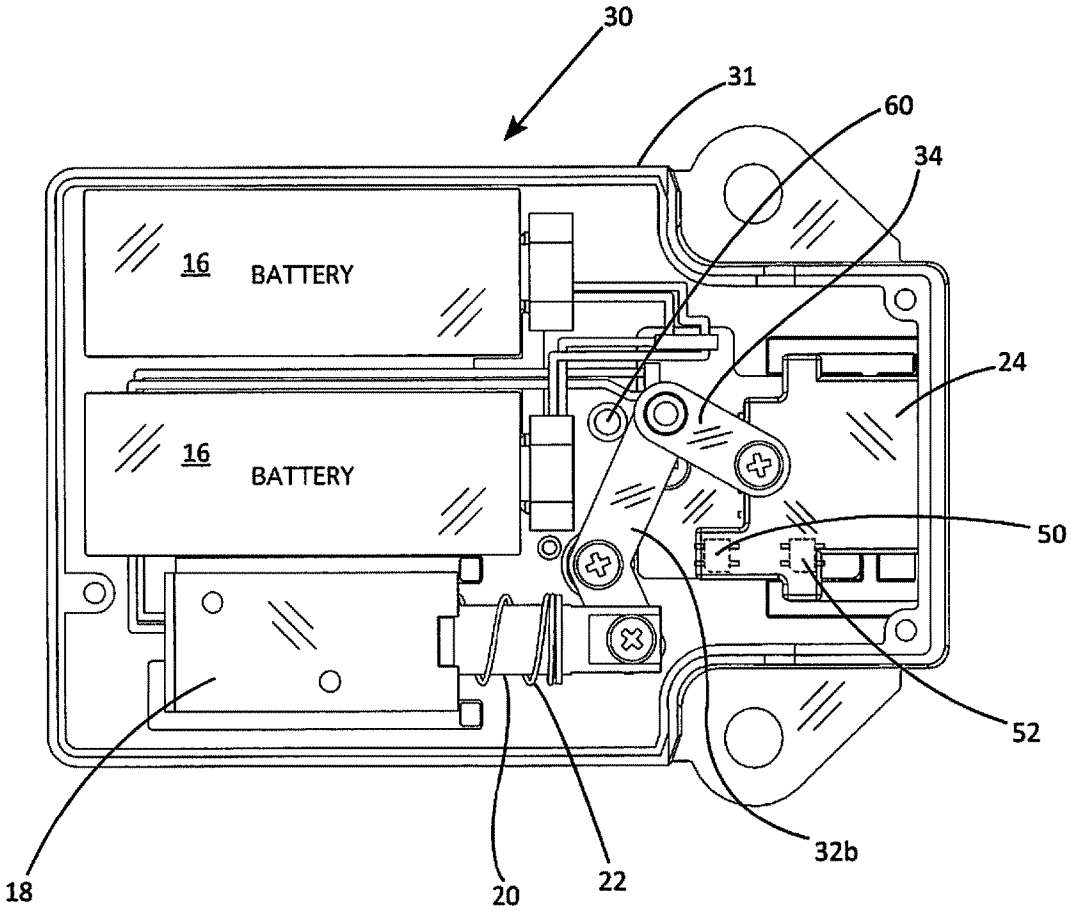
FIG. 2 is a view similar to FIG. 1, but showing the locking element in a retracted (unlocked) position.
Figure 4:
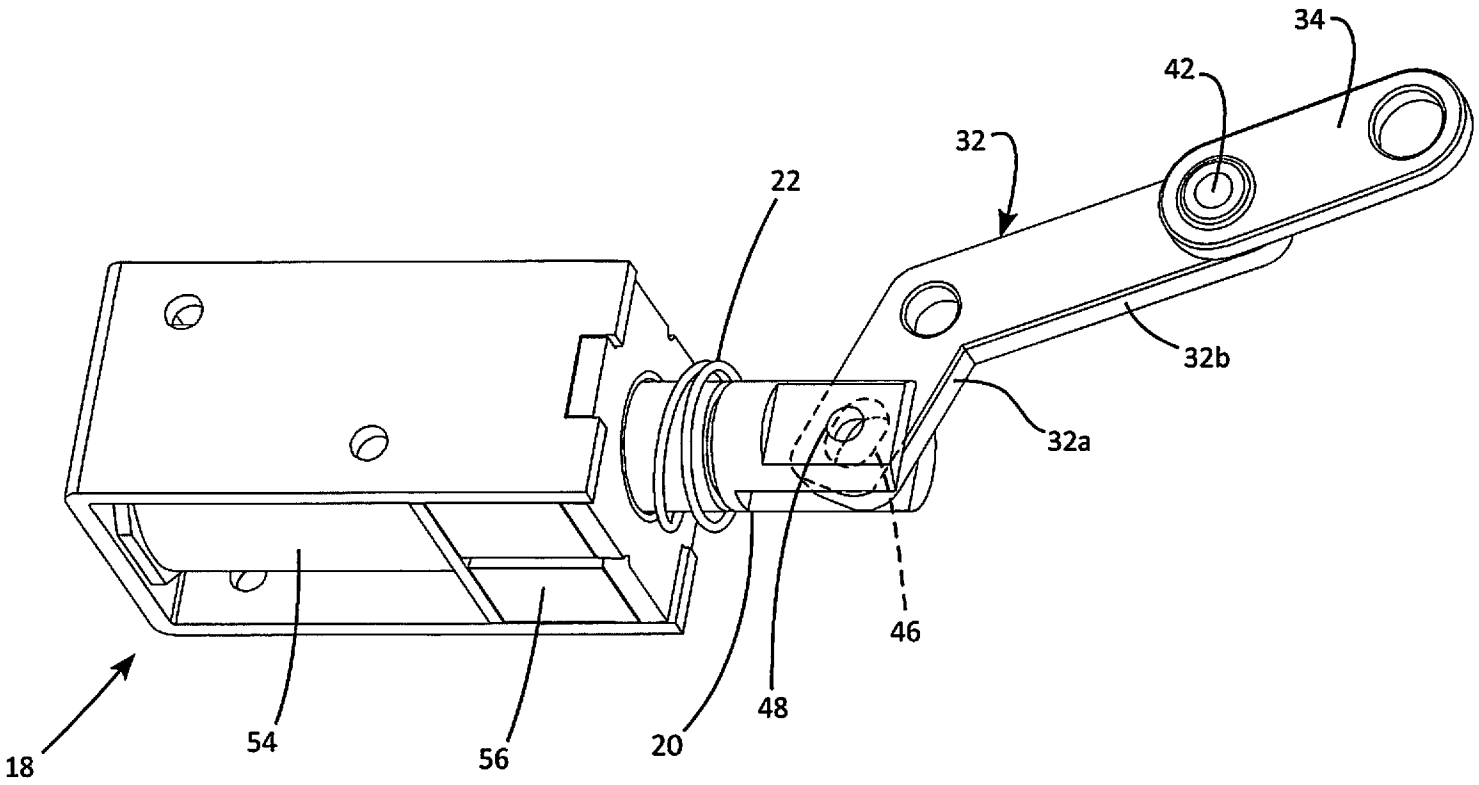
FIG. 4 is a perspective view showing the solenoid, plunger and mechanical elements of the lock of the invention.

Rather than directly driving the bolt, the plunger 20 of the solenoid 18 drives the bolt indirectly, through a mechanical linkage that includes a lever 32 and a link 34. The lever 32 has two arms, a first arm 32*a* and a second arm 32*b*. The lever is pivoted from a fixed pivot point position 36 on the housing, which can be via a machine screw as shown at 36. When the lock is fully extended, as shown in FIG. 1, these mechanical components are so positioned that the second arm 32*b* of the lever and the link 34 are directly in alignment. Thus, pushing inwardly on the lock bolt 24 will not cause the solenoid plunger to retract and allow the bolt to be manually retracted. The link 34 is pivotally secured to the lock bolt at a pivot connection 40, and to the outer end of the second arm 32*b* at a pivot connection 42. The outer end of the plunger 20 is secured to the end of the first arm 32*a* of the lever at a free-pivoting connection 44, a connection that also allows for a slight sliding translation. Comparing FIGS. 1 and 2, the latter showing the mechanical arrangement in the bolt-retracted position, it is seen that while the solenoid plunger 20 travels in a linear path, the end of the lever's second arm 32*a* actually moves in an arcuate path. For this reason, the end of the first lever arm 32*a* has an opening 46 that is slightly elongated as shown in FIG. 4. A fastener that makes the connection, seen at 44 in FIGS. 1 and 2, passes through a round bore 48 in the plunger (or two round bores of a split-end solenoid as seen in FIG. 4), and this pivot fastener is allowed to travel along this oblong, slightly slotted opening 46 in the first lever arm as needed. Note that the angle of the first arm 32*a*, in relation to the line of travel of the plunger 20, preferably is selected so that first arm 32*a* is substantially perpendicular to plunger travel at a position that is halfway through the plunger's travel. Thus, the angles of the first arm 32*a* in FIGS. 2 and 1 are essentially equally displaced from a right angle plunger position, aft and fore of that position. This minimizes sliding travel of the pivot member along the arm. In addition, positioning the arc of travel to straddle the right-angle position maximizes mechanical advantage of the plunger acting on the first lever arm 32*a*.

Comparing FIGS. 1 and 2, it is seen that the bolt 24 is retracted by extension of the solenoid plunger 20. The extension of the plunger is by applying the appropriate voltage polarity to the solenoid coil. The lock is typically an electronic lock operated to unlock or lock by entry of a code on a keypad or by use of a hand-held electronic contact or proximity device, or via a network. The first arm 32*a* of the lever is shorter than the second arm 32*b*, with the ratio of these two lengths being chosen appropriately to produce the desired throw distance for the bolt 24. The ratio is about 2:1 in the example shown. As FIG. 2 shows, the forward movement of the plunger and the end of the short arm 32*a* rotates the lever 32 about the housing-mounted pivot point 36, swinging the end of the long arm 32*b* counterclockwise in these views. This swings the pivot connection 42 with the link, pulling the link 34 back while rotating the link somewhat about the bolt pivot connection 40.

In a preferred embodiment the throw of the deadbolt 24 is increased by the invention from the approximately ¼ inch typical of the prior art to over ½ inch, approximately 13 to 14 mm.

Sensors can be included in the lock housing, to indicate lock status. Two sensors are shown at 50 and 52. These two sensors, which can be electromagnetic or optical (or a limit switch) and sensitive to the presence of the adjacent deadbolt, confirm that the deadbolt 24 is fully extended as in FIG. 1, or fully retracted as in FIG. 2. A circuit board is shown at 53, and the sensors can be mounted on the circuit board.

Figure 3:
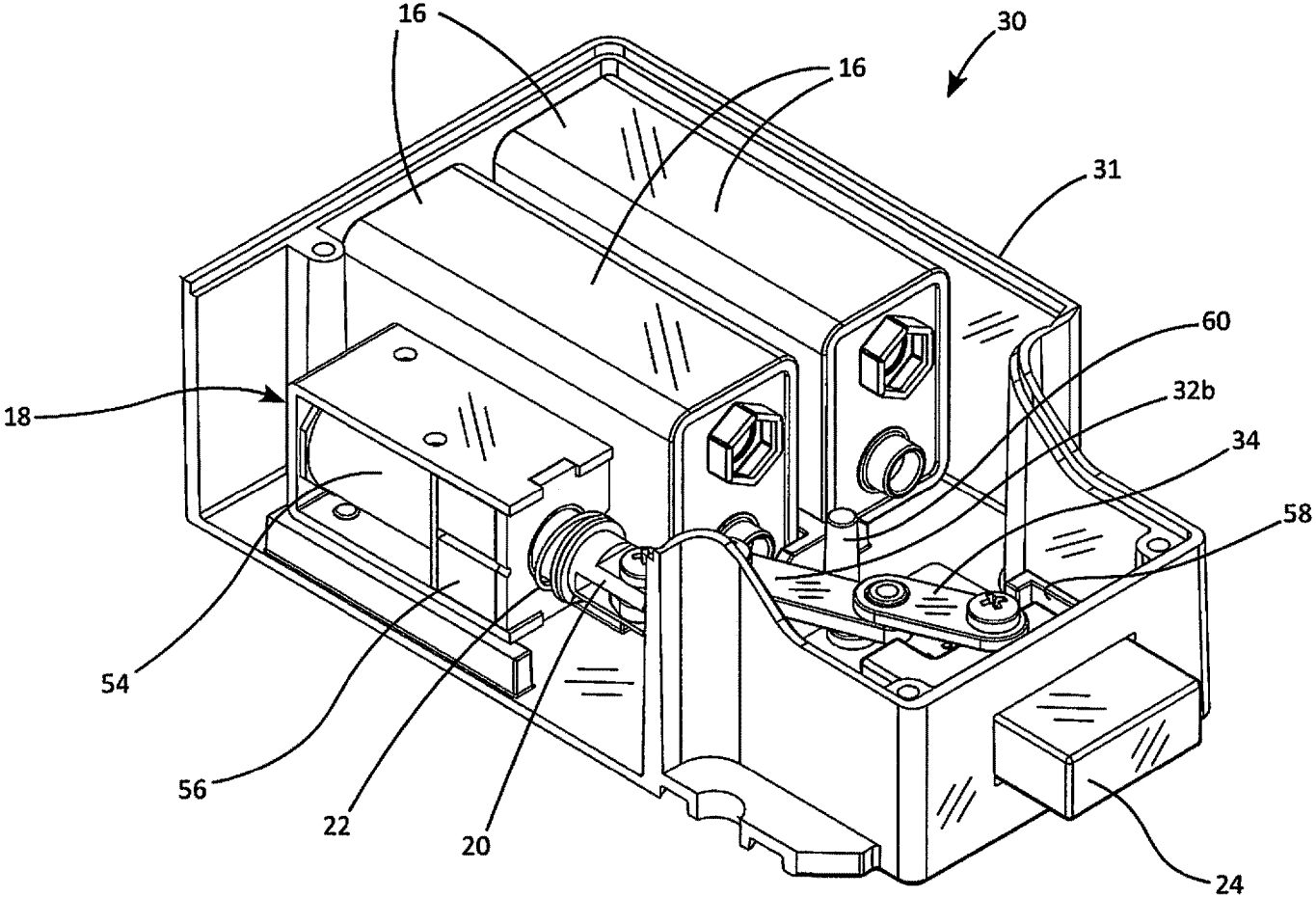
FIG. 3 is a perspective view showing the lock unit of FIGS. 1 and 2, with the lock element extended, and with the cover and a wall of the housing removed for clarity.

The perspective views of FIGS. 3 and 4 show certain elements not visible in other views. These views show a solenoid coil 54 within the solenoid unit 18, and also a permanent magnet 56 at the forward end of the solenoid unit, acting on the plunger 20 in the manner described previously. Also, the deadbolt 24 is shown in FIG. 3 within its slide track 58, and details of the pivot connections are better revealed. In addition, FIG. 3 shows a stop post 60 that can provide a retraction limit for the bolt 24. This is also seen in FIGS. 1 and 2, with FIG. 2 showing the lever 32 engaged against the post 60 as a limit to movement of the mechanism and of the bolt. The retracted limit position of the bolt could be established by other means, such as a housing-connected stop directly in the path of the bolt 24.

In a preferred embodiment as illustrated, the angle of the aligned link 34 and lever arm 32*b*, as relates to the line of travel of the bolt 24, is about 22° (or about 20° or 24°). The angle defined by the lever 32 itself, between the arms 32*b* and 32*a* (i.e. the change in direction from the arm 32*a* into the arm 32*b*), is about 57° (or about 55° to 60°). The obtuse angle defined at the pivot point 36 would accordingly be 120° to 125°. It should be understood that the solenoid could be positioned in any desired orientation within the housing, with a practical arrangement being shown in the drawings, and the angles above relating to that particular practical arrangement in the illustrated housing 31. The lever 32 could have the short arm 32*a* at any reasonable angle relative to the long arm 32*b*, and the solenoid would then be positioned so that its plunger travel line would relate to the arc of travel of the short arm 32*a* in the manner described above, for minimal sliding and to maximize mechanical advantage. The angle described above between the second arm 32*b*/link 34 and the bolt line of travel could be 0° (alignment) if desired, the important factor being that the second arm 32*b* and the link 34 be in alignment when the bolt is fully extended. Further, the ratio of the long arm 32*b* to the short arm 32*a* could be different from the approximate 2:1 shown.

Still further, it is possible to eliminate the link 34, and instead provide a sliding pivot connection between the outer end of the second arm 32*b* and the base end of the bolt 24. This would simply be a slot in the inner end of the bolt, perpendicular to the direction of bolt travel, with a pin or fastener (such as 42) extending directly through that slot. The positioning of the components would then be such that the bolt is fully extended when the second arm is toward the bottom of the bolt slot as the bolt is seen in FIG. 1, with the second arm aligned with bolt travel when the bolt is fully extended. The second arm would be to the extreme top of the bolt slot when the bolt is retracted. The bolt base could be wider (taller as seen in the drawings) to provide a wide slot for adequate bolt throw. A ball bearing could be used in the slot for reduced friction. The embodiment depicted in FIGS. 1 through 4 is preferred, but such a modified arrangement is possible.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. In an electronic deadbolt lock having a housing, a reciprocating bolt that extends from the housing in an extended position and retracts into the housing to a retracted position, a keep solenoid connected to drive the bolt, the keep solenoid having an electromagnetic coil and a plunger for linear reciprocating travel inwardly and outwardly relative to and under the influence of the coil so as to drive the bolt between the extended and retracted positions, the keep solenoid being configured to maintain the bolt in the retracted position without power to the coil and to maintain the bolt in the extended position without power to the coil, the improvement comprising:

a pivoted lever mounted for pivoting about a pivot point on the housing, the lever having a first arm on a first side of the pivot point and a second arm on a second side of the pivot point, the first arm having an end connected to the plunger so as to be swung in either of two opposed rotational directions about the pivot point by the inward and outward movements of the plunger so as to drive the bolt between the extended and retracted positions, said end of the first arm that is connected to the plunger being secured to the plunger in a manner that allows for relative sliding motion as well as rotational motion between the plunger and the first arm of the lever, the second arm of the lever having an outer end extending to a position near the bolt, a pivoted link connecting the bolt with the outer end of the second arm, at pivot connections on the second arm's outer end and on the bolt, and the second arm of the lever and the link being configured such that when the bolt is in the extended position the link and the second arm are aligned, with said pivot point of the lever and the two pivot connections of the link all in alignment, whereby, with the bolt in the extended position, inward force exerted on the bolt from outside the housing cannot be effective to retract the bolt because of the alignment of the link and the second arm of the lever.

2. The electronic deadbolt lock of claim 1, wherein the plunger has a bore with a pivot fastener through the bore, and the first arm has an elongated hole receiving the pivot fastener.

3. The electronic deadbolt lock of claim 1, wherein the first and second arms of the lever are not aligned but are obliquely angled relative to one another, and wherein the second arm is angularly offset from the first arm by an angle of about 55° to 60°.

* * * * *